US008899413B2

(12) United States Patent
Pruett

(10) Patent No.: US 8,899,413 B2
(45) Date of Patent: Dec. 2, 2014

(54) COMBINED GIFT PRODUCT AND CHOCOLATE BAR GREETING CARD

(71) Applicant: Paul Pruett, Salem, MA (US)

(72) Inventor: Paul Pruett, Salem, MA (US)

( * ) Notice: Subject to any disclaimer, the term of this patent is extended or adjusted under 35 U.S.C. 154(b) by 0 days.

(21) Appl. No.: 13/774,017

(22) Filed: Feb. 22, 2013

(65) Prior Publication Data

US 2013/0213833 A1 Aug. 22, 2013

Related U.S. Application Data

(60) Provisional application No. 61/601,594, filed on Feb. 22, 2012.

(51) Int. Cl.

| | |
|---|---|
| ***B65D 73/00*** | (2006.01) |
| ***B42D 15/00*** | (2006.01) |
| ***B65D 5/42*** | (2006.01) |

(52) U.S. Cl.

CPC ..... *B65D 73/0078* (2013.01); *B42D 15/00* (2013.01); *B65D 5/4208* (2013.01); *B65D 5/4237* (2013.01)

USPC ..... 206/232; 206/459.5; 206/472; 229/92.8

(58) Field of Classification Search

USPC ..... 206/232, 459.5, 472–475; 229/92.8; 40/124.1–124.6, 701–710, 722–724, 40/124.01–124.06; 426/106

See application file for complete search history.

(56) References Cited

U.S. PATENT DOCUMENTS

| | | | | |
|---|---|---|---|---|
| 4,203,516 | A * | 5/1980 | Stonoga et al. | 229/92.8 |
| 5,096,058 | A * | 3/1992 | Juravin et al. | 206/232 |
| 5,213,214 | A * | 5/1993 | Stringham | 229/68.1 |
| 5,407,076 | A * | 4/1995 | Sabet | 206/472 |
| 5,458,235 | A * | 10/1995 | Stone | 206/232 |
| 5,794,631 | A * | 8/1998 | Sylvester | 206/232 |
| 6,070,719 | A * | 6/2000 | Pollock | 206/232 |
| 6,659,271 | B2 * | 12/2003 | Parsons | 206/232 |
| 6,868,964 | B2 * | 3/2005 | Carty et al. | 206/232 |
| 2003/0230501 | A1 * | 12/2003 | Smolev | 206/232 |
| 2010/0270181 | A1 * | 10/2010 | Morgan | 206/459.5 |

* cited by examiner

*Primary Examiner* — Bryon Gehman
(74) *Attorney, Agent, or Firm* — Daniel N. Smith

(57) ABSTRACT

A gift product which holds a single, individually-wrapped chocolate bar, currency bills, and one or more gift cards. The gift product has a greeting card panel and a chocolate bar container. The internal face of the greeting card panel has a pocket that holds currency bills and a gift card. The gift product is preferably formed from a single blank made of box stock, reinforced paper, or thin plastic.

16 Claims, 8 Drawing Sheets

COMBINED GIFT PRODUCT AND CHOCOLATE BAR GREETING CARD

CROSS REFERENCE TO RELATED APPLICATION

This application claims the benefit of U.S. Provisional Patent Application No. 61/601,594 filed on Feb. 22, 2012, the contents of which are incorporated herein by reference.

FIELD OF THE INVENTION

This invention relates to a novel gift product that is a greeting card combined with a chocolate bar holder, a gift card holder and a money holder.

BACKGROUND OF INVENTION

It can often be difficult to find gifts for family, friends, co-workers and acquaintances. Money holders and, more recently, gift card holders allow gift givers to send money and gift cards along with a personal message. In addition, candy gifts are often accompanied by a card or note upon which the sender of the gift can write a personal message to the recipient. The card might be adhesively attached to the candy gift, or might be secured to the candy gift by the ribbon or cord.

This invention relates to a versatile type of personal or corporate gift product that allows the giver flexibility in giving a chocolate bar, a gift card, money, and an additional gift, all combined with one personal or marketing message. The configuration of this gift product is substantially flat to allow for placement into an envelope.

SUMMARY OF THE INVENTION

There are additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

The subject invention discloses a gift product comprising a substantially rectangular-cuboid shaped container configured to removably hold a single, individually-wrapped, substantially rectangular-cuboid shaped chocolate bar; a substantially rectangular-shaped opening on the top of the container for removing the chocolate bar; a tuck flap configured to fold over and close the opening on the top of the container to hold the chocolate bar; wherein the gift product further comprises a greeting card formed in one piece with the rectangular-cuboid shaped container, the greeting card comprising a substantially flat front wall of the rectangular-cuboid shaped container and a substantially flat panel formed in one piece with the front wall; wherein the flat panel is attached to the front wall along a flexible hinge with the flat panel being pivotal between a closed position in which the panel covers the front wall and an open position in which the panel uncovers the front wall; the panel having an internal surface which is visible when the panel is in the open position; a pocket on the internal surface of the panel, wherein the pocket is configured to removably hold a plurality of currency bills in a readily accessible position; two spaced indentations on the surface of the pocket, wherein the two spaced indentations are substantially mirror images of each other, further wherein the two indentations are configured to removably hold a gift card in a steady position on the gift product; the front wall having printed indicia thereon that can be viewed when the panel is in the open position to a person holding the gift product; and the panel having an outside surface which is visible when the panel is in the closed position, with the outside surface having printed indicia thereon that can be viewed when the panel is in the closed position to a person holding the gift product.

The term "substantially" is defined as at least close to (and can include) a given value or state, as understood by a person of ordinary skill in the art. In one embodiment, the term "substantially" refers to ranges within 10%, preferably within 5%, more preferably within 1%, and most preferably within 0.1% of the given value or state being specified.

The subject invention also discloses a gift product comprising a substantially rectangular-cuboid shaped container configured to removably hold a single, individually-wrapped, substantially rectangular-cuboid shaped chocolate bar; a substantially rectangular-shaped opening on the bottom of the container for removing the chocolate bar; a tuck flap configured to fold over and close the opening on the bottom of the container to hold the chocolate bar; wherein the gift product further comprises a greeting card formed in one piece with the rectangular-cuboid shaped container, the greeting card comprising a substantially flat front wall of the rectangular-cuboid shaped container and a substantially flat panel formed in one piece with the front wall; wherein the flat panel is attached to the front wall along a flexible hinge with the flat panel being pivotal between a closed position in which the panel covers the front wall and an open position in which the panel uncovers the front wall; the panel having an internal surface which is visible when the panel is in the open position; a pocket on the internal surface of the panel, wherein the pocket has a continuous opening that extends vertically along the flexible hinge and then curves outward towards a free edge of the panel, further wherein the pocket is configured to removably hold a plurality of currency in a readily accessible position; two spaced indentations on the surface of the pocket, wherein the two spaced indentations are substantially mirror images of each other, further wherein the two indentations are configured to removably hold a gift card in a steady position on the gift product; the front wall having printed indicia thereon that can be viewed when the panel is in the open position to a person holding the gift product; and the panel having an outside surface which is visible when the panel is in the closed position, with the outside surface having printed indicia thereon that can be viewed when the panel is in the closed position to a person holding the gift product.

The subject invention discloses a gift product comprising a substantially rectangular-cuboid shaped container configured to removably hold a single, individually-wrapped, substantially rectangular-cuboid shaped chocolate bar; a substantially rectangular-shaped opening on the top of the container for removing the chocolate bar; a tuck flap configured to fold over and close the opening on the top of the container to hold the chocolate bar; wherein the gift product further comprises a greeting card formed in one piece with the rectangular-cuboid shaped container, the greeting card comprising a substantially flat front wall of the rectangular-cuboid shaped container and a substantially flat planar base formed in one piece with the front wall; wherein the flat planar base is attached to the front wall along a flexible hinge with the flat planar base being pivotal between a closed position in which the planar base covers the front wall and an open position in which the planar base uncovers the front wall; the planar base having an internal surface which is visible when the planar base is in the open position; a pocket on the internal surface of the planar base, wherein the pocket is configured to removably hold a plurality of currency bills in a readily accessible position; two spaced indentations on the surface of the pocket, wherein the two spaced indentations are substantially mirror images of each other, further wherein the two indentations are configured to removably hold a gift card in a steady position on the gift product; the front wall having printed indicia thereon that can be viewed when the planar base is in the open position to a person holding the gift product; and the planar base having an outside surface which is visible when the planar base is in the closed position, with the outside surface having printed indicia thereon that can be viewed when the planar base is in the closed position to a person holding the gift product.

Further embodiments of the subject invention comprise a tab extending outwardly from the free edge of the panel, and a slot on the free edge of the front wall, wherein the slot is configured to removably receive the tab when the panel is in the closed position covering the front wall.

In other embodiments of the subject invention, the substantially rectangular-cuboid shaped container, the panel forming the greeting card, the tuck flap, flexible hinge and the pocket are components of a single blank of box stock, lightweight fiberboard, cardboard, or thin sheets of plastic.

In a further embodiment of the subject invention, the printed indicia on the front wall and the outside surface of the panel may be identical or different indicia; in further embodiments these indicia may be personal, corporate, or advertising messages, logos or images.

Another embodiment of the subject invention is a gift product composed of a single sheet blank having a plurality of score lines for folding the blank and for separating the sheet blank into a plurality of panels, the sheet blank comprising: a message panel having a substantially rectangular configuration; a first side panel having a substantially rectangular configuration and hingedly connected to the message panel at a first fold line along adjacent longitudinal edges of the message panel and the first side panel; a back panel having a substantially rectangular configuration, the back panel hingedly connected to the first side panel at a second fold line along adjacent longitudinal edges of the back panel and the first side panel; a second side panel having a substantially rectangular configuration and hingedly connected to the back panel at a third fold line along adjacent longitudinal edges of the second side panel and the back panel; a front panel having a substantially rectangular configuration, the front panel hingedly connected to the second side panel at a fourth fold line along adjacent longitudinal edges of the second side panel and the front panel; a third side panel having a substantially rectangular configuration and hingedly connected to the front panel at a fifth fold line along adjacent longitudinal edges of the second side panel and the back panel; a first closure panel hingedly connected to the front panel at a first closure fold line along adjacent latitudinal edges of the first closure panel and the front panel; a first tuck flap hingedly connected to the first closure panel at a second closure fold line along adjacent latitudinal edges of the first closure panel and the first tuck flap; a second closure panel hingedly connected to the front panel at a third closure fold line along adjacent latitudinal edges of the second closure panel and the front panel; a second tuck flap hingedly connected to the second closure panel at a fourth closure fold line along adjacent latitudinal edges of the second closure panel and the second tuck flap; wherein a substantially rectangular-cuboid shaped container configured to removably hold a single, individually-wrapped, substantially rectangular-cuboid shaped chocolate bar is formed by folding the sheet blank along the third through sixth fold lines such that the front and back panels and the second and third side panels form opposing, spaced apart walls of the container, the container being further formed by folding the sheet blank along the first through fourth closure fold lines so that the first and second closure panels close the opposite ends of the candy compartment with the first tuck flap and the second tuck flap; and wherein the blank is further foldable along the first and second fold lines such that the first side panel and the third side panel are in a generally face-to-face juxtaposition and the message panel is freely foldable to and from a generally face-to-face juxtaposition with the front panel to form a greeting card on the container; a pocket on an internal surface of the message panel; a pocket on the internal surface of the message panel, wherein the pocket is configured to removably hold a plurality of currency bills in a readily accessible position; two spaced indentations on the surface of the pocket, wherein the two spaced indentations are substantially mirror images of each other, further wherein the two indentations are configured to removably hold a gift card in a steady position on the gift product; wherein the front panel has printed indicia thereon; and an external surface of the message panel has printed indicia thereon.

Further embodiments of the subject invention comprise a tab extending outwardly from the free edge of the message panel, and a slot on the free edge of the front panel, wherein the slot is configured to removably receive the tab when the message is folded over panel the front panel.

Another embodiment of the subject invention is a gift product composed of a single sheet blank having a plurality of score lines for folding the sheet blank into a plurality of panels, the sheet blank comprising: a message panel having a substantially rectangular configuration; a first side panel having a substantially rectangular configuration and hingedly connected to the message panel at a first fold line along adjacent longitudinal edges of the message panel and the first side panel; a back panel having a substantially rectangular configuration, the back panel hingedly connected to the first side panel at a second fold line along adjacent longitudinal edges of the back panel and the first side panel; a second side panel having a substantially rectangular configuration and hingedly connected to the back panel at a third fold line along adjacent longitudinal edges of the second side panel and the back panel; a front panel having a substantially rectangular configuration, the front panel hingedly connected to the second side panel at a fourth fold line along adjacent longitudinal edges of the second side panel and the front panel; a third side panel having a substantially rectangular configuration and hingedly connected to the front panel at a fifth fold line along adjacent longitudinal edges of the third side panel and the front panel; a first closure panel hingedly connected to the top of the front panel at a first closure fold line along adjacent latitudinal edges of the first closure panel and the front panel; a first tuck flap hingedly connected to the first closure panel at a second closure fold line along adjacent latitudinal edges of the first closure panel and the first tuck flap; a second closure panel hingedly connected to the bottom of the front panel at a third closure fold line along adjacent latitudinal edges of the second closure panel and the front panel; a second tuck flap hingedly connected to the second closure panel at a fourth closure fold line along adjacent latitudinal edges of the second closure panel and the second tuck flap; wherein a substantially rectangular-cuboid shaped container configured to removably hold a single, individually-wrapped, substantially rectangular-cuboid shaped chocolate bar is formed by folding the sheet blank along the third through fifth fold lines such that the front and back panels and the second and third side panels form opposing, spaced apart walls of the container, the container being further formed by folding the sheet blank along the first through fourth closure fold lines so that the first and second closure panels close the opposite ends of the candy compartment with the first tuck flap and the second tuck flap; wherein the blank is further foldable along the first and second fold lines such that the first side panel and the third side panel are in a generally face-to-face juxtaposition and the message panel is freely foldable to and from a generally face-to-face juxtaposition with a front surface of the front panel to form a greeting card on the container, wherein the front surface of the front panel comprises printed indicia thereon, further wherein an external surface of the message panel comprises printed indicia thereon; a pocket on an internal surface of the message panel, wherein the pocket is configured to removably hold a plurality of currency bills in a readily accessible position; and two spaced indentations on the surface of the pocket, wherein the two spaced indentations are substantially mirror images of each other, further wherein the two indentations are configured to removably hold a gift card in a steady position on the gift product.

Another embodiment of the subject invention is a gift product composed of a single sheet blank having a plurality of score lines for folding the sheet blank into a plurality of substantially flat bases, the sheet blank comprising: a message substantially flat base having a substantially rectangular configuration; a first side substantially flat base having a substantially rectangular configuration and hingedly connected to the message substantially flat base at a first fold line along adjacent longitudinal edges of the message substantially flat base and the first side substantially flat base; a back substantially flat base having a substantially rectangular configuration, the back substantially flat base hingedly connected to the first side substantially flat base at a second fold line along adjacent longitudinal edges of the back substantially flat base and the first side substantially flat base; a second side substantially flat base having a substantially rectangular configuration and hingedly connected to the back substantially flat base at a third fold line along adjacent longitudinal edges of the second side substantially flat base and the back substantially flat base; a front substantially flat base having a substantially rectangular configuration, the front substantially flat base hingedly connected to the second side substantially flat base at a fourth fold line along adjacent longitudinal edges of the second side substantially flat base and the front substantially flat base; a third side substantially flat base having a substantially rectangular configuration and hingedly connected to the front substantially flat base at a fifth fold line along adjacent longitudinal edges of the third side substantially flat base and the front substantially flat base; a first closure substantially flat base hingedly connected to the top of the front substantially flat base at a first closure fold line along adjacent latitudinal edges of the first closure substantially flat base and the front substantially flat base; a first tuck flap hingedly connected to the first closure substantially flat base at a second closure fold line along adjacent latitudinal edges of the first closure substantially flat base and the first tuck flap; a second closure substantially flat base hingedly connected to the bottom of the front substantially flat base at a third closure fold line along adjacent latitudinal edges of the second closure substantially flat base and the front substantially flat base; a second tuck flap hingedly connected to the second closure substantially flat base at a fourth closure fold line along adjacent latitudinal edges of the second closure substantially flat base and the second tuck flap; wherein a substantially rectangular-cuboid shaped container configured to removably hold a single, individually-wrapped, substantially rectangular-cuboid shaped chocolate bar is formed by folding the sheet blank along the third through fifth fold lines such that the front and back substantially flat bases and the second and third side substantially flat bases form opposing, spaced apart walls of the container, the container being further formed by folding the sheet blank along the first through fourth closure fold lines so that the first and second closure substantially flat bases close the opposite ends of the candy compartment with the first tuck flap and the second tuck flap; wherein the blank is further foldable along the first and second fold lines such that the first side substantially flat base and the third side substantially flat base are in a generally face-to-face juxtaposition and the message substantially flat base is freely foldable to and from a generally face-to-face juxtaposition with a front surface of the front substantially flat base to form a greeting card on the container, wherein the front surface of the front substantially flat base comprises printed indicia thereon, further wherein an external surface of the message substantially flat base comprises printed indicia thereon; a pocket on an internal surface of the message substantially flat base, wherein the pocket is configured to removably hold a plurality of currency bills in a readily accessible position; and two spaced indentations on the surface of the pocket, wherein the two spaced indentations are substantially mirror images of each other, further wherein the two indentations are configured to removably hold a gift card in a steady position on the gift product.

Another embodiment of the subject invention is a gift product composed of a single sheet blank having a plurality of score lines for folding the sheet blank into a plurality of substantially planar panels, the sheet blank comprising: a message substantially planar panel having a substantially rectangular configuration; a first side substantially planar panel having a substantially rectangular configuration and hingedly connected to the message substantially planar panel at a first fold line along adjacent longitudinal edges of the message substantially planar panel and the first side substantially planar panel; a back substantially planar panel having a substantially rectangular configuration, the back substantially planar panel hingedly connected to the first side substantially planar panel at a second fold line along adjacent longitudinal edges of the back substantially planar panel and the first side substantially planar panel; a second side substantially planar panel having a substantially rectangular configuration and hingedly connected to the back substantially planar panel at a third fold line along adjacent longitudinal edges of the second side substantially planar panel and the back substantially planar panel; a front substantially planar panel having a substantially rectangular configuration, the front substantially planar panel hingedly connected to the second side substantially planar panel at a fourth fold line along adjacent longitudinal edges of the second side substantially planar panel and the front substantially planar panel; a third side substantially planar panel having a substantially rectangular configuration and hingedly connected to the front substantially planar panel at a fifth fold line along adjacent longitudinal edges of the third side substantially planar panel and the front substantially planar panel; a first closure substantially planar panel hingedly connected to the top of the front substantially planar panel at a first closure fold line along adjacent latitudinal edges of the first closure substantially planar panel and the front substantially planar panel; a first tuck flap hingedly connected to the first closure substantially planar panel at a second closure fold line along adjacent latitudinal edges of the first closure substantially planar panel and the first tuck flap; a second closure substantially planar panel hingedly connected to the bottom of the front substantially planar panel at a third closure fold line along adjacent latitudinal edges of the second closure substantially planar panel and the front substantially planar panel; a second tuck flap hingedly connected to the second closure substantially planar panel at a fourth closure fold line along adjacent latitudinal edges of the second closure substantially planar panel and the second tuck flap; wherein a substantially rectangular-cuboid shaped container configured to removably hold a single, individually-wrapped, substantially rectangular-cuboid shaped chocolate bar is formed by folding the sheet blank along the third through fifth fold lines such that the front and back substantially planar panels and the second and third side substantially planar panels form opposing, spaced apart walls of the container, the container being further formed by folding the sheet blank along the first through fourth closure fold lines so that the first and second closure substantially planar panels close the opposite ends of the candy compartment with the first tuck flap and the second tuck flap; wherein the blank is further foldable along the first and second fold lines such that the first side substantially planar panel and the third side substantially planar panel are in a generally face-to-face juxtaposition and the message substantially planar panel is freely foldable to and from a generally face-to-face juxtaposition with a front surface of the front substantially planar panel to form a greeting card on the container, wherein the front surface of the front substantially planar panel comprises printed indicia thereon, further wherein an external surface of the message substantially planar panel comprises printed indicia thereon; a pocket on an internal surface of the message substantially planar panel, wherein the pocket is configured to removably hold a plurality of currency bills in a readily accessible position; and two spaced indentations on the surface of the pocket, wherein the two spaced indentations are substantially mirror images of each other, further wherein the two indentations are configured to removably hold a gift card in a steady position on the gift product.

Another embodiment of the subject invention is a gift product composed of a single sheet blank having a plurality of score lines for folding the sheet blank into a plurality of panels, the sheet blank comprising: a message panel having a substantially rectangular configuration; a first side panel having a substantially rectangular configuration and hingedly connected to the message panel at a first score line along adjacent longitudinal edges of the message panel and the first side panel; a back panel having a substantially rectangular configuration, the back panel hingedly connected to the first side panel at a second score line along adjacent longitudinal edges of the back panel and the first side panel; a second side panel having a substantially rectangular configuration and hingedly connected to the back panel at a third score line along adjacent longitudinal edges of the second side panel and the back panel; a front panel having a substantially rectangular configuration, the front panel hingedly connected to the second side panel at a fourth score line along adjacent longitudinal edges of the second side panel and the front panel; a third side panel having a substantially rectangular configuration and hingedly connected to the front panel at a fifth score line along adjacent longitudinal edges of the third side panel and the front panel; a first closure panel hingedly connected to the top of the front panel at a first closure score line along adjacent latitudinal edges of the first closure panel and the front panel; a first tuck flap hingedly connected to the first closure panel at a second closure score line along adjacent latitudinal edges of the first closure panel and the first tuck flap; a second closure panel hingedly connected to the bottom of the front panel at a third closure score line along adjacent latitudinal edges of the second closure panel and the front panel; a second tuck flap hingedly connected to the second closure panel at a fourth closure score line along adjacent latitudinal edges of the second closure panel and the second tuck flap; wherein a substantially rectangular-cuboid shaped container configured to removably hold a single, individually-wrapped, substantially rectangular-cuboid shaped chocolate bar is formed by folding the sheet blank along the third through fifth score lines such that the front and back panels and the second and third side panels form opposing, spaced apart walls of the container, the container being further formed by folding the sheet blank along the first through fourth closure score lines so that the first and second closure panels close the opposite ends of the candy compartment with the first tuck flap and the second tuck flap; wherein the blank is further foldable along the first and second score lines such that the first side panel and the third side panel are in a generally face-to-face juxtaposition and the message panel is freely foldable to and from a generally face-to-face juxtaposition with a front surface of the front panel to form a greeting card on the container, wherein the front surface of the front panel comprises printed indicia thereon, further wherein an external surface of the message panel comprises printed indicia thereon; a pocket on an internal surface of the message panel, wherein the pocket is configured to removably hold a plurality of currency bills in a readily accessible position; and two spaced indentations on the surface of the pocket, wherein the two spaced indentations are substantially mirror images of each other, further wherein the two indentations are configured to removably hold a gift card in a steady position on the gift product.

Another embodiment of the subject invention is a gift product composed of a single sheet blank having a plurality of score lines for folding the sheet blank into a plurality of panels, the sheet blank comprising: a message panel having a substantially rectangular configuration; a first side panel having a substantially rectangular configuration and hingedly connected to the message panel at a first fold line along adjacent longitudinal edges of the message panel and the first side panel; a back panel having a substantially rectangular configuration, the back panel hingedly connected to the first side panel at a second fold line along adjacent longitudinal edges of the back panel and the first side panel; a second side panel having a substantially rectangular configuration and hingedly connected to the back panel at a third fold line along adjacent longitudinal edges of the second side panel and the back panel; a front panel having a substantially rectangular configuration, the front panel hingedly connected to the second side panel at a fourth fold line along adjacent longitudinal edges of the second side panel and the front panel; a third side panel having a substantially rectangular configuration and hingedly connected to the front panel at a fifth fold line along adjacent longitudinal edges of the third side panel and the front panel; a first closure panel hingedly connected to the top of the front panel at a first closure fold line along adjacent latitudinal edges of the first closure panel and the front panel; a first tuck flap hingedly connected to the first closure panel at a second closure fold line along adjacent latitudinal edges of the first closure panel and the first tuck flap; a second closure panel hingedly connected to the bottom of the front panel at a third closure fold line along adjacent latitudinal edges of the second closure panel and the front panel; a second tuck flap hingedly connected to the second closure panel at a fourth closure fold line along adjacent latitudinal edges of the second closure panel and the second tuck flap; wherein a substantially rectangular-cuboid shaped container configured to removably hold a single, individually-wrapped, substantially rectangular-cuboid shaped chocolate bar is formed by folding the sheet blank along the third through fifth fold lines such that the front and back panels and the second and third side panels form opposing, spaced apart walls of the container, the container being further formed by folding the sheet blank along the first through fourth closure fold lines so that the first and second closure panels close the opposite ends of the candy compartment with the first tuck flap and the second tuck flap; wherein the blank is further foldable along the first and second fold lines such that the first side panel and the third side panel are in a generally face-to-face juxtaposition and the message panel is freely foldable to and from a generally face-to-face juxtaposition with a front surface of the front panel to form a greeting card on the container, wherein the front surface of the front panel comprises printed indicia thereon, further wherein an external surface of the message panel comprises printed indicia thereon; a pocket on an internal surface of the message panel, wherein the pocket is configured to removably hold a plurality of currency bills in a readily accessible position; and two spaced indentations on the surface of the pocket, wherein the two spaced indentations are substantially mirror images of each other, further wherein the two indentations are configured to removably hold a gift card in a steady position on the gift product.

Further embodiments of the subject invention comprise a tab extending outwardly from the free edge of the message panel, and a slot on the free edge of the front panel, wherein the slot is configured to removably receive the tab when the message panel is folded into the generally face-to-face juxtaposition with the front surface of the front panel to form the greeting card on the container.

In other embodiments of the subject invention, the single sheet blank may be composed of box stock, lightweight fiberboard, cardboard, or thin sheets of plastic.

In a further embodiment of the subject invention, the printed indicia on the front panel and the external surface of the message panel may be identical or different indicia; in further embodiments these indicia may be personal, corporate, or advertising messages, logos or images.

The subject invention also discloses a combined greeting card, money holder, gift card holder and a chocolate bar container comprising: a) a substantially rectangular-cuboid shaped container configured to removably hold a single, individually-wrapped, substantially rectangular-cuboid shaped chocolate bar having a front panel defining a front face, a rear panel defining a rear face, and a top, bottom, left, and right panel each disposed between and connecting said front panel and said rear panel; b) a container-covering panel hingedly attached to the left panel, the panel having an internal surface which is visible when the panel is in the open position; c) a pocket on the internal surface of the container-covering panel, wherein the pocket is configured to removably hold a plurality of currency bills in a readily accessible position; d) two spaced indentations on the surface of the pocket, wherein the two spaced indentations are substantially mirror images of each other, further wherein the two indentations are configured to removably hold a gift card in a steady position on the gift product; e) the front face having printed indicia thereon that can be viewed when the panel is in the open position to a person holding the gift product; and f) the panel having an outside surface which is visible when the panel is in the closed position, with the outside surface having printed indicia thereon that can be viewed when the panel is in the closed position to a person holding the gift product.

Further embodiments of the subject invention comprise a tab extending outwardly from the free edge of the panel, and a slot on the free edge of the front wall, wherein the slot is configured to removably receive the tab when the panel is in the closed position covering the front wall.

In other embodiments of the subject invention, the substantially rectangular-cuboid shaped container, the panel forming the greeting card, flexible hinge and the pocket are components of a single blank of box stock, lightweight fiberboard, cardboard, or thin sheets of plastic.

In a further embodiment of the subject invention, the printed indicia on the front wall and the outside surface of the panel may be identical or different indicia; in further embodiments these indicia may be personal, corporate, or advertising messages, logos or images.

The subject invention further discloses a combined greeting card, money holder, gift card holder and a chocolate bar container comprising: a) a substantially rectangular-cuboid shaped container configured to removably hold a single, individually-wrapped, substantially rectangular-cuboid shaped chocolate bar having a front panel defining a front face, a rear panel defining a rear face, a top panel, a bottom panel, a left panel, and a right panel each disposed between and connecting said front panel and said rear panel; b) a container-covering panel hingedly attached to the left panel, the container-covering panel having an internal surface which is visible when the container-covering panel is in the open position and an external surface which is visible when the container-covering panel is in the closed position, with the external surface comprising printed indicia thereon that can be viewed when the container-covering panel is in the closed position to a person holding the combined greeting card, money holder, gift card holder and chocolate bar container; c) a pocket on the internal surface of the container-covering panel, wherein the pocket is configured to removably hold a plurality of currency bills in a readily accessible position; d) two spaced indentations on the surface of the pocket, wherein the two spaced indentations are substantially mirror images of each other, further wherein the two indentations are configured to removably hold a gift card in a steady position on the combined greeting card, money holder, gift card holder and chocolate bar container; and e) the front face comprising printed indicia thereon that can be viewed when the container-covering panel is in the open position to a person holding the combined greeting card, money holder, gift card holder and chocolate bar container.

Further embodiments of the subject invention comprise a tab extending outwardly from the free edge of the container-covering panel, and a slot on the free edge of the front wall, wherein the slot is configured to removably receive the tab when the container-covering panel is in the closed position covering the front wall.

In other embodiments of the subject invention, the substantially rectangular-cuboid shaped container, the container-covering panel forming the greeting card, flexible hinge and the pocket are components of a single blank of box stock, lightweight fiberboard, cardboard, or thin sheets of plastic.

In a further embodiment of the subject invention, the printed indicia on the front wall and the outside surface of the container-covering panel may be identical or different indicia; in further embodiments these indicia may be personal, corporate, or advertising messages, logos or images.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto. These together with other objects of the invention, along with the various features of novelty, which characterize the invention, are pointed out with particularity in the claims annexed to and forming a part of this disclosure.

For a better understanding of the invention, its operating advantages and the specific objects attained by its uses, reference should be made to the accompanying drawings and descriptive matter in which there are illustrated embodiments of the invention. Other features and advantages of the present invention will become apparent from the following description of the embodiment(s), taken in conjunction with the accompanying drawings, which illustrate, by way of example, the principles of the invention.

BRIEF DESCRIPTION OF THE DRAWINGS

Advantages of the present invention will be apparent from the following detailed description of embodiments thereof, which description should be considered in conjunction with the accompanying drawings, in which.

DETAILED DESCRIPTION OF THE PREFERRED EMBODIMENTS

While several variations of the present invention have been illustrated by way of example in particular embodiments, it is apparent that further embodiments could be developed within the spirit and scope of the present invention, or the inventive concept thereof. It is to be expressly understood that such modifications and adaptations are within the spirit and scope of the present invention, and are inclusive, but not limited to the following appended claims as set forth.

Figure 1:
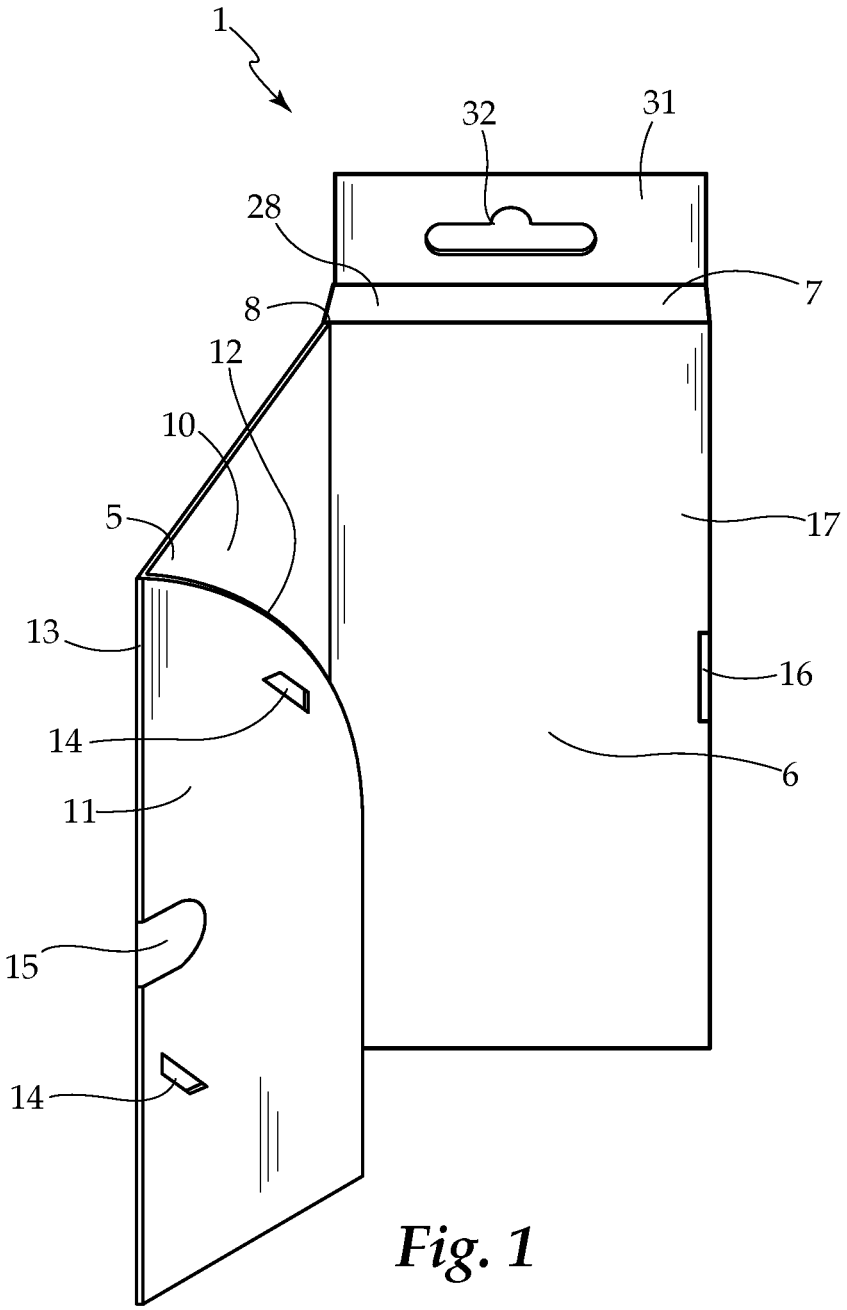
FIG. 1 illustrates a top perspective view of one embodiment of the combination gift product and chocolate bar greeting card in the open position.
Figure 2:
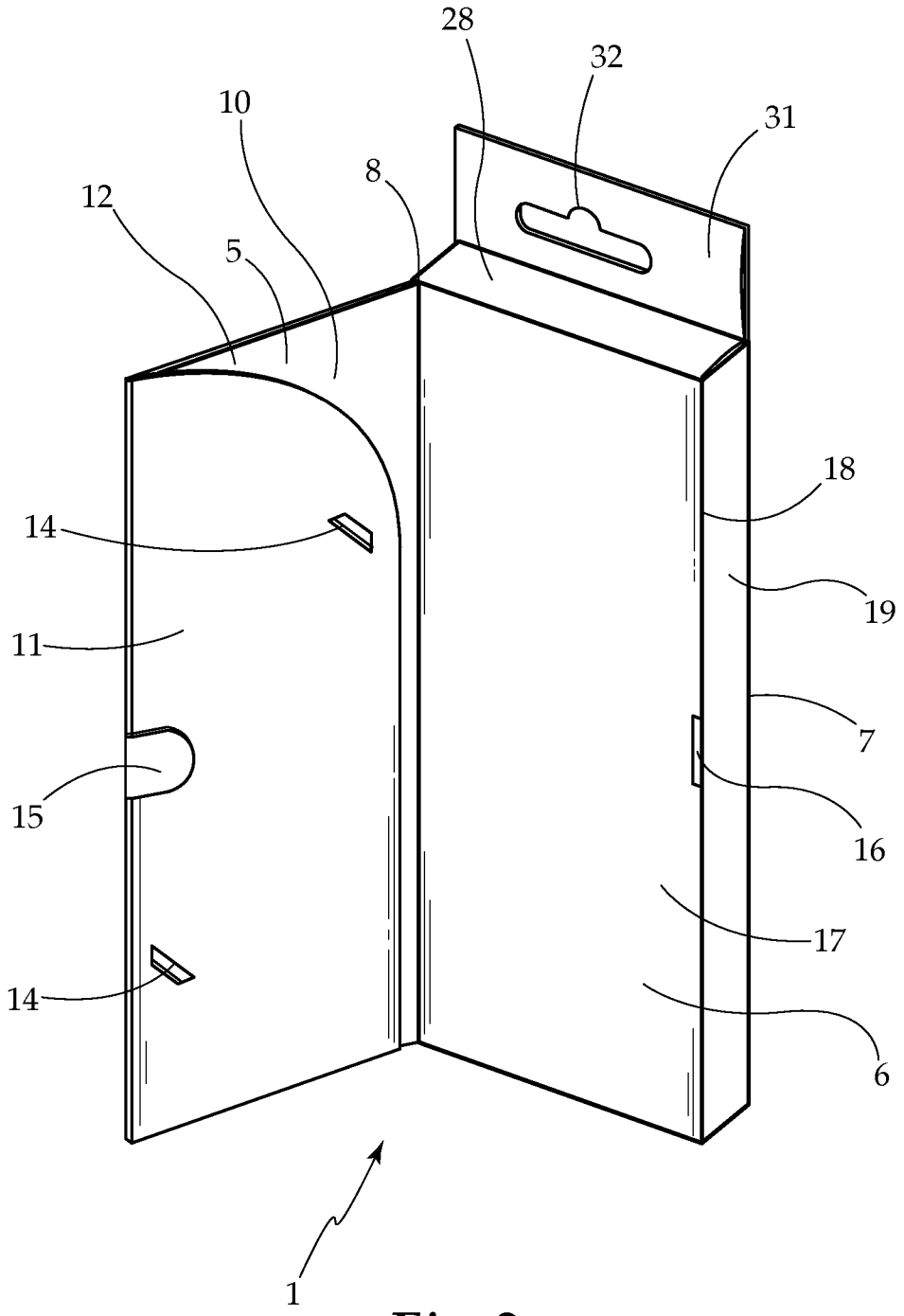
FIG. 2 illustrates a front perspective view of one embodiment of the combination gift product and chocolate bar greeting card in the open position.
Figure 3:
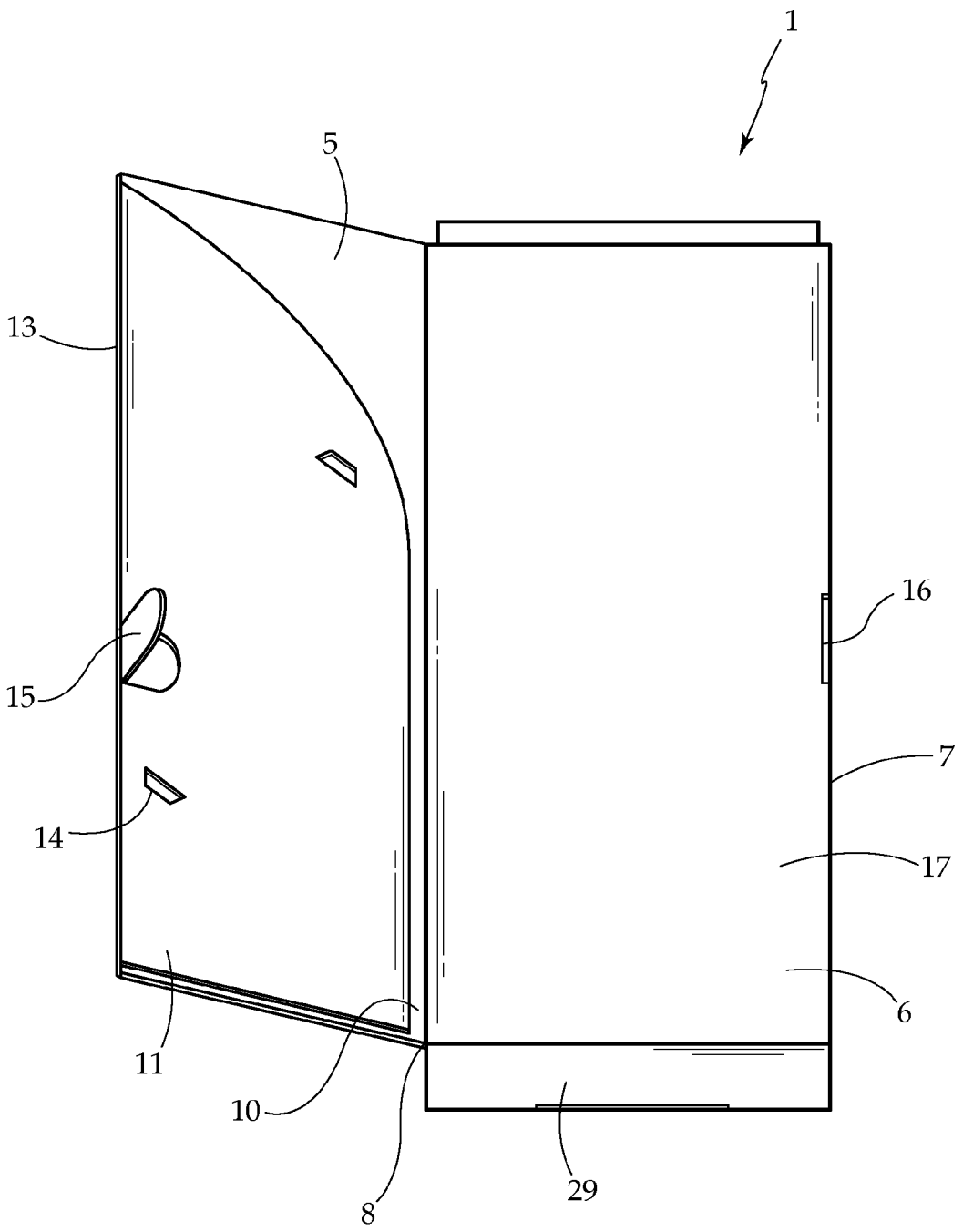
FIG. 3 illustrates a front view of one embodiment of the combination gift product and chocolate bar greeting card in the open position.
Figure 5:
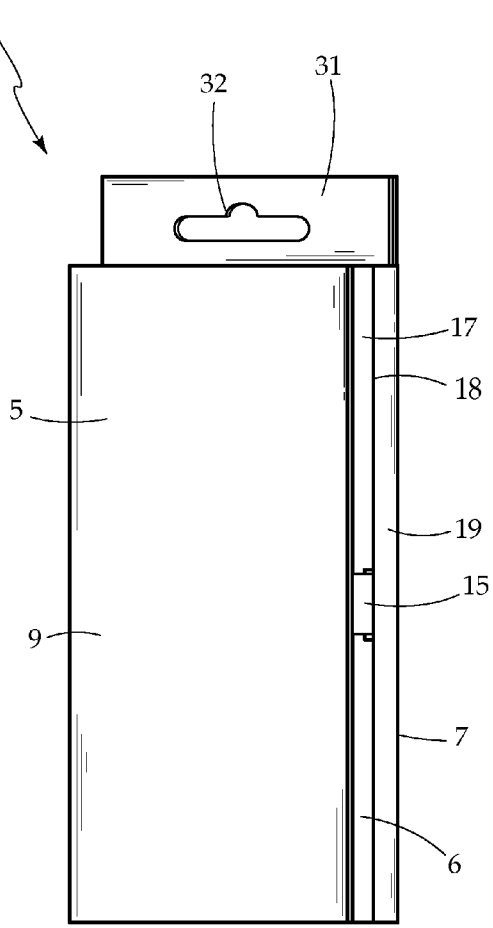
FIG. 5 illustrates a front view of one embodiment of the combination gift product and chocolate bar greeting card in the closed position.
Figure 4:
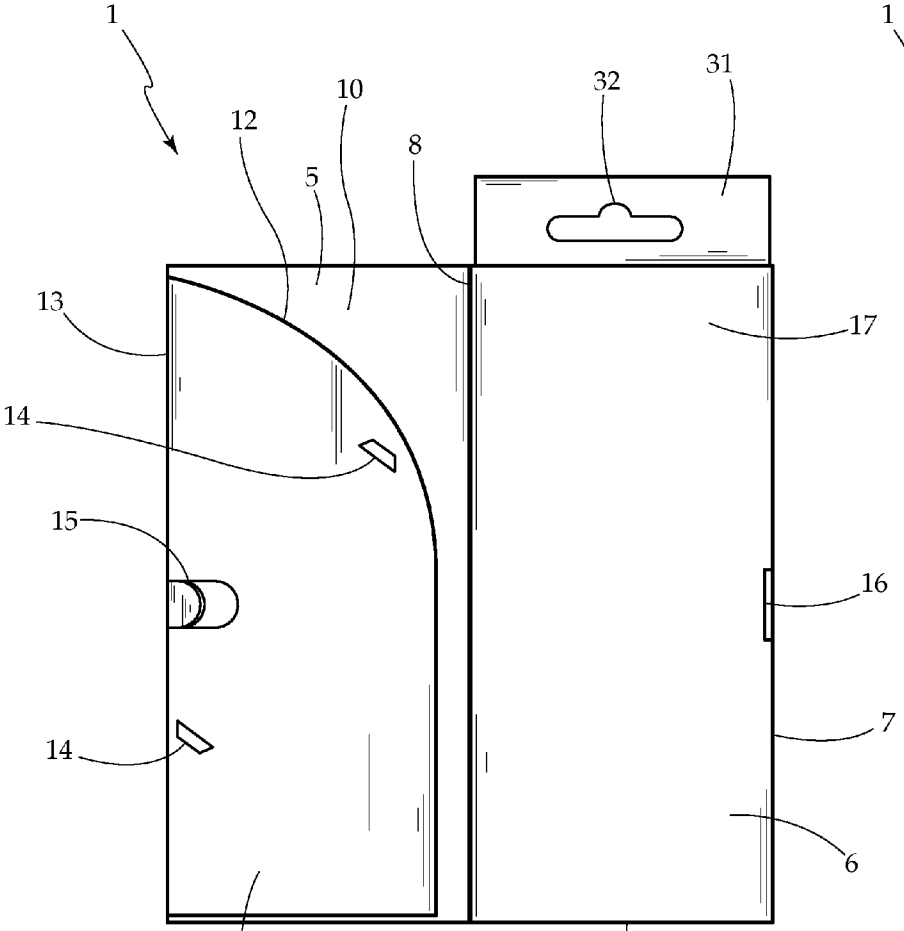
FIG. 4 illustrates a front view of one embodiment of the combination gift product and chocolate bar greeting card in the open position.
Figure 6:
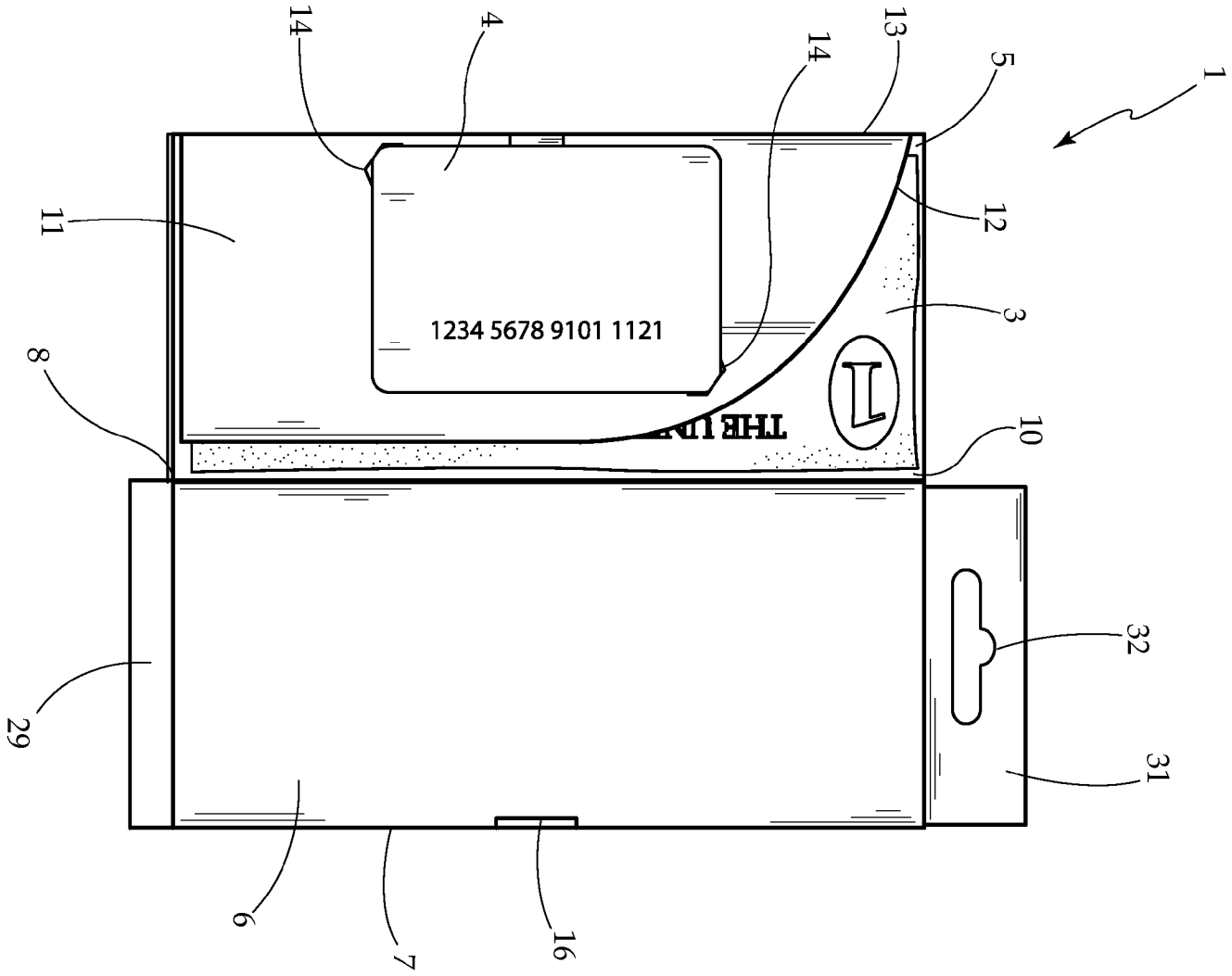
FIG. 6 illustrates a front view of one embodiment of the combination gift product and chocolate bar greeting card in the open position containing money and a gift card.
Figure 7:
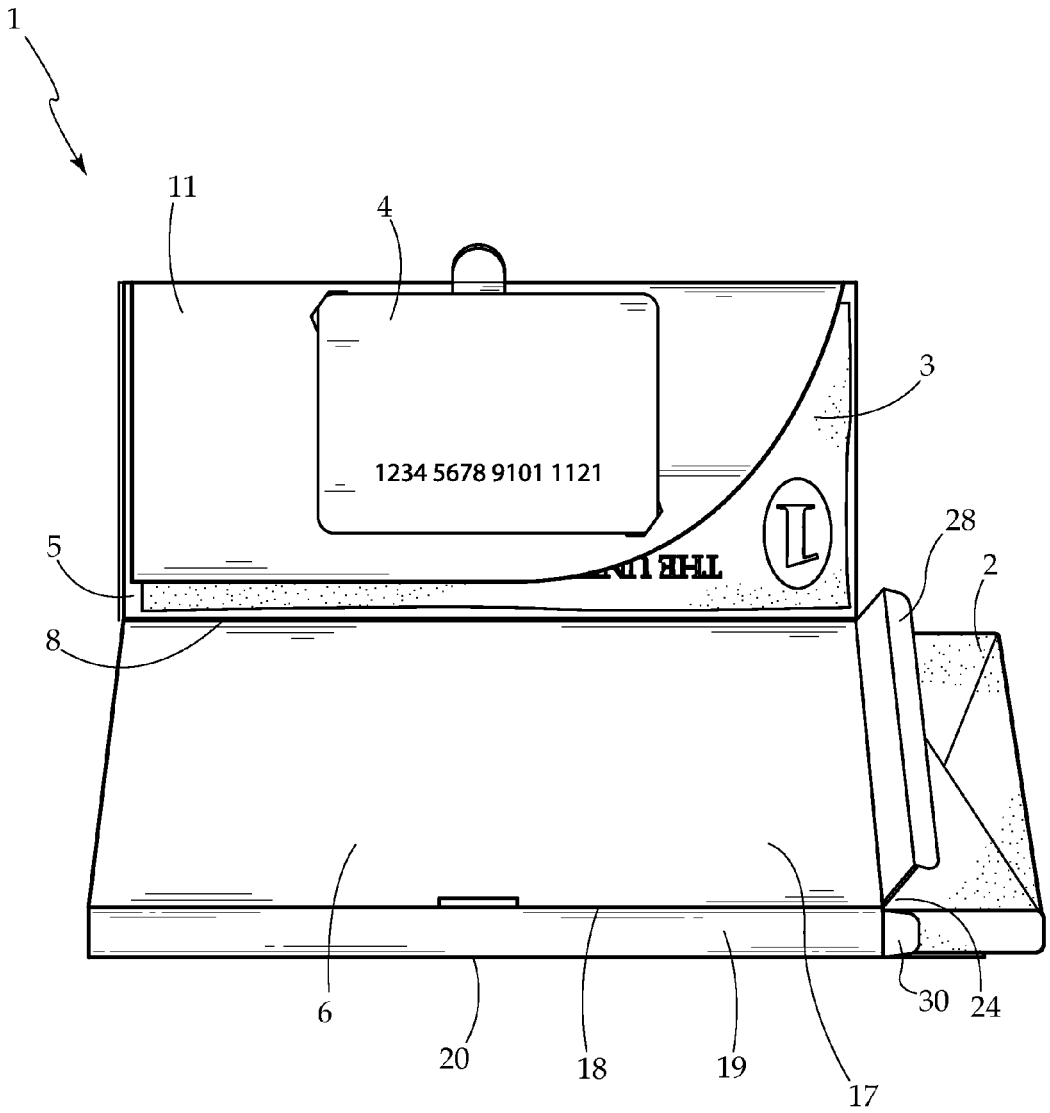
FIG. 7 illustrates a side perspective view of one embodiment of the combination gift product and chocolate bar greeting card in the open position containing money, a gift card, and a chocolate bar.
Figure 8:
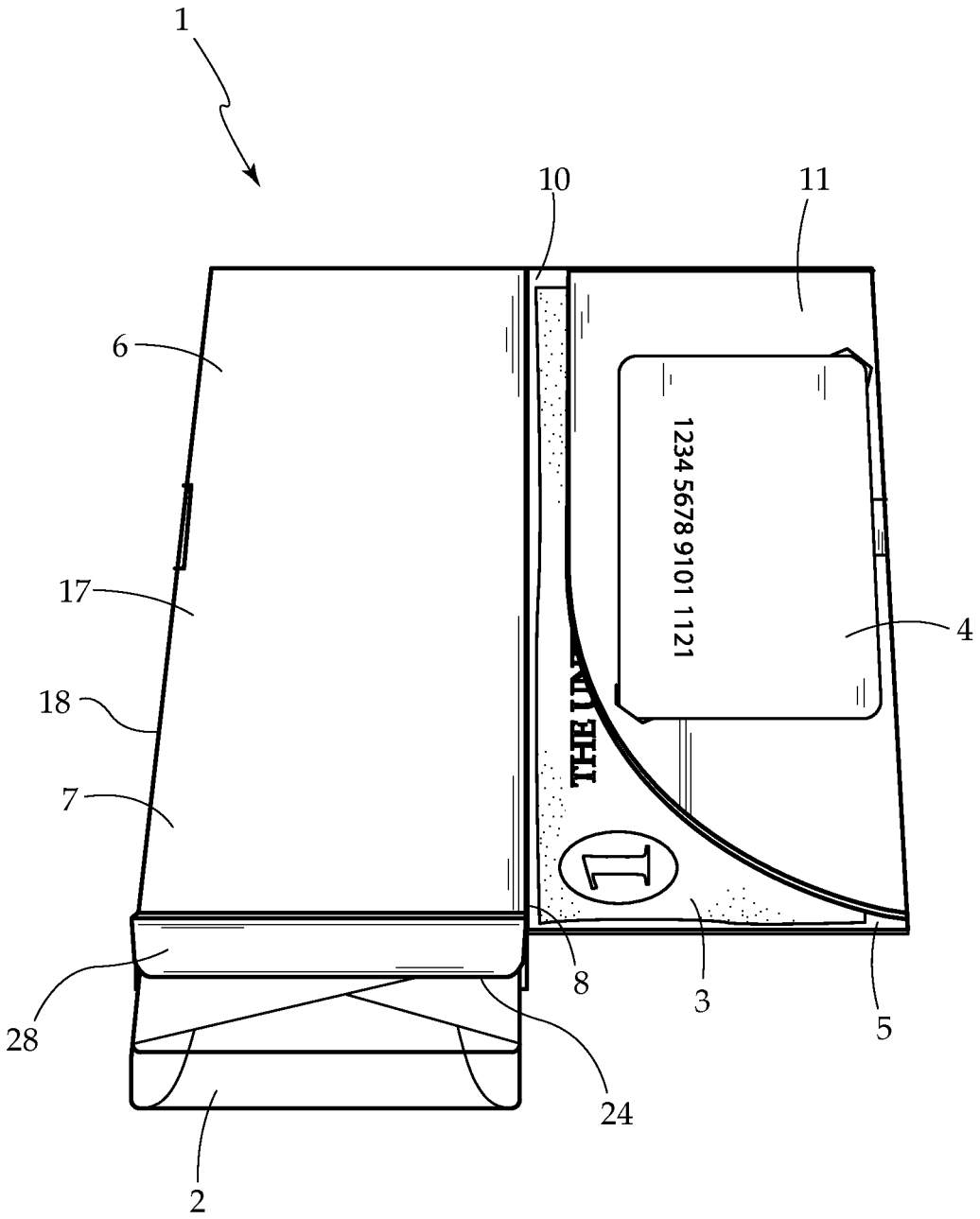
FIG. 8 illustrates a top view of one embodiment of the combination gift product and chocolate bar greeting card in the open position containing money, a gift card, and a chocolate bar.
Figure 9:
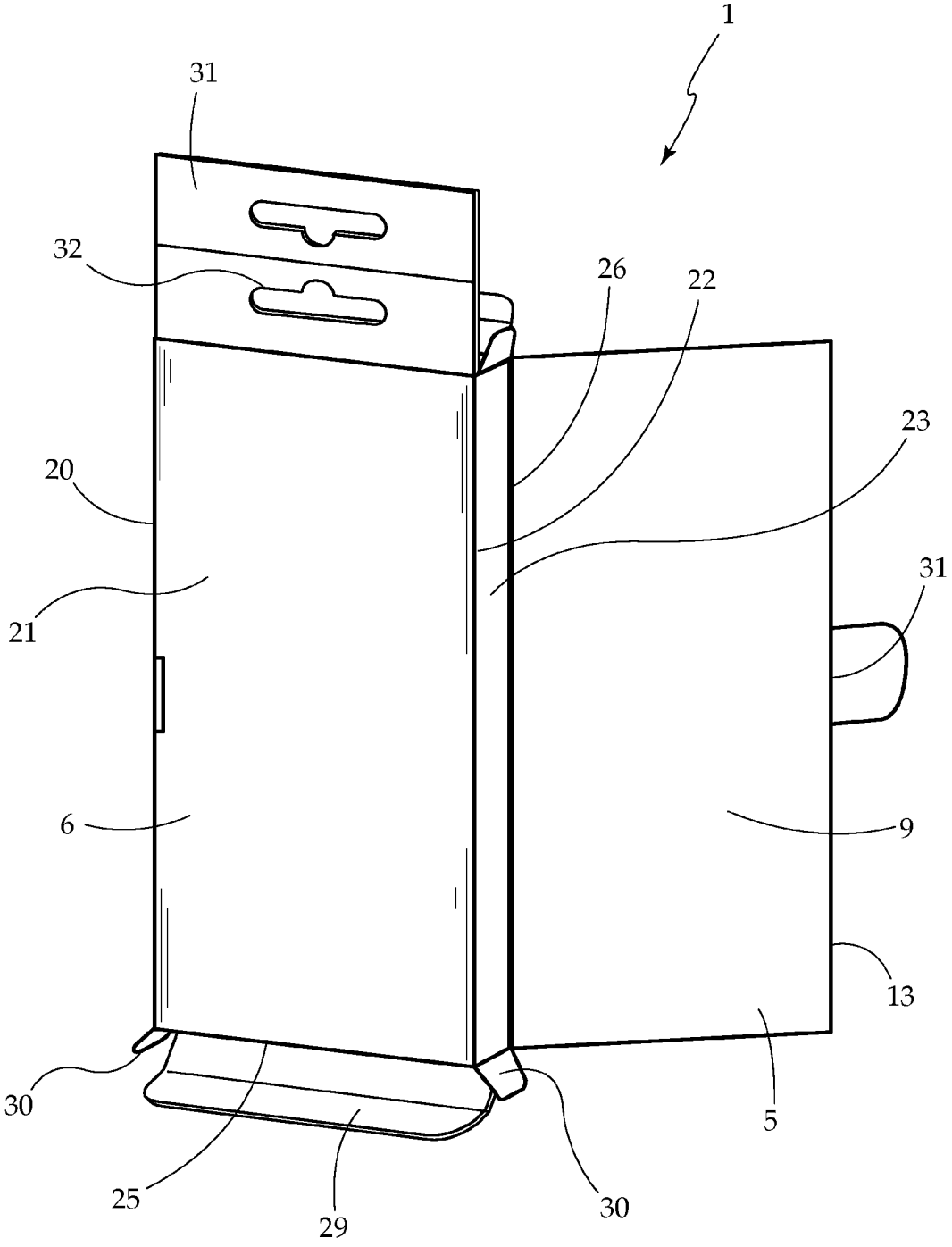
FIG. 9 illustrates a rear view of one embodiment of the combination gift product and chocolate bar greeting card in the open position.

The subject invention is a greeting card gift product 1, illustrated in FIGS. 1-9, which may hold a single, individually-wrapped chocolate bar 2, a plurality of currency bills 3 and one or more gift cards 4, as illustrated in FIGS. 6-8.

The gift product has a substantially flat rectangular shaped greeting card panel 5 that is hingedly attached to a front wall 6 of a rectangular-cuboid shaped chocolate bar container 7.

The hinge attachment 8 allows the greeting card panel 5 to pivot from the open position, as illustrated in FIGS. 1-4 and 6-9, to fold over the front wall 6 into a closed position, as illustrated in FIG. 5. Greeting card panel 5 has an external face 9 which may have printed indicia thereon that can be viewed to a person holding the gift product 1 when the panel 5 is in the closed position.

Greeting card panel 5 also has an internal face 10. The internal face 10 has a pocket 11 configured to removably hold a plurality of currency bills 3, as illustrated in FIGS. 6-8. In one embodiment of the gift product 1, pocket 11 may have a continuous opening 12 that extends vertically along the flexible hinge 8 and then curves outward towards a free edge 13 of the greeting card panel 5

Pocket 11 also contains one or more spaced indentations 14 on the top surface of the pocket. These spaced indentations 14 may be substantially mirror images of each other. The indentations 14 are configured to removably hold a gift card 4 in a steady position on the gift product 1, as illustrated in FIGS. 6-9.

Message panel 5 may also have a tab 15 that extends outwardly from the free edge 13 of panel 15. The front wall 6 of the chocolate bar container 7 may have a slot 16 for slidably receiving tab 15 when message panel 5 is in the closed position, as illustrated in FIG. 5.

The greeting card panel 14 can pivot to an open position, as illustrated in FIGS. 1-4 and 6-9, so that the front wall 6 is uncovered. In the open position, both the front wall 6 and the internal face 10 of the greeting card panel 5 are visible to a person handling the gift product 1. In the open position, the greeting card panel 14 and the front wall 6 of the candy box effectively form a greeting card. Front wall 6 may have printed indicia thereon that can be viewed to a person holding the gift product 1 when the greeting card panel 5 is in the open position. In addition, in the open position, a person holding the gift product 1 can view the pocket 11 holding currency bills 3 and indentations 14 holding a gift card 4.

Thus, the gift product 1 can be used as a greeting card as follows: a person views the gift product 1 in the closed position, as shown in FIG. 5, with printed indicia on the external face 9 of the greeting card panel 5. The person then opens the greeting card by pivotally moving greeting card panel 5 through hinge attachment 8 to view the printed indicia on front wall 6; the currency bills 3 in pocket 11 and the gift card 4 on indentations 14.

The rectangular-cuboid shaped chocolate bar container 7 further contains a chocolate bar 2 as illustrated in FIGS. 6-8.

The gift product 1, including the greeting card panel 5 and the container 7, is preferably formed from a single blank made of cardboard-like box stock, reinforced paper, or thin plastic. In embodiments of the subject invention, the edges of the container 7 disclosed below be formed by scoring lines directly into a single blank of material, such as cardboard, reinforced paper, or thin plastic.

The blank comprises a substantially flat and rectangular-shaped container front wall panel 17 pivotally attached on edge 18 to a substantially flat and rectangular-shaped container side panel 19. The opposite edge 20 of rectangular-shaped container side panel 19 is pivotally attached to a substantially flat and rectangular-shaped container back wall panel 21. The opposite edge 22 of back wall panel 21 is attached to a substantially flat and rectangular-shaped container side panel 23. This forms a substantially rectangular-shaped top opening 24 and a substantially rectangular-shaped bottom opening 25. Either opening 24 or 25 may be used to insert or remove a substantially rectangular-cuboid shaped chocolate bar 2 into container 7. Thus, these panels 17, 19, 21 and 23 form a substantially rectangular-cuboid shaped container 7 configured to removably hold a single, individually-wrapped, substantially rectangular-cuboid shaped chocolate bar 2 with the front wall panel 17 forming the front wall 6.

The opposite edge 26 of container side panel 23 is pivotally attached greeting card panel 5. In another embodiment of the subject invention, container side panel 23 may be adhered to an additional side panel (not shown) pivotally attached greeting card panel 5. In a further embodiment of the subject invention, greeting card panel 5 may be pivotally attached to edge 27 of container front wall panel 17.

The container 7 may have pivotal closure tuck flaps 28, 29 at opposite ends of the container front wall panel 17 to close the top and bottom openings 24, 25 of the container 7. Each container side panel 19 and 23 may have end closure flaps 30 pivotally secured thereto to help securely close the top and bottom openings 24, 25 of the container 7.

In this embodiment, the container back wall panel 21 may contain a large extended hanging flap 31 with a hook opening 32 to hang the gift product 1 from a standard retail hook.

The many aspects and benefits of the invention are apparent from the detailed description, and thus, it is intended for the following claims to cover such aspects and benefits of the invention, which fall within the scope, and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

What is claimed is:

1. A gift product comprising:

a substantially rectangular-cuboid shaped container configured to removably hold a single, individually-wrapped, substantially rectangular-cuboid shaped chocolate bar;

a substantially rectangular-shaped opening on the top of the container for removing the chocolate bar;

a tuck flap configured to fold over and close the opening on the top of the container to hold the chocolate bar;

wherein the gift product further comprises a greeting card formed in one piece with the rectangular-cuboid shaped container, the greeting card comprising a substantially flat front wall of the rectangular-cuboid shaped container and a substantially flat panel formed in one piece with the front wall, wherein the flat panel is attached to the front wall along a flexible hinge with the flat panel being pivotal between a closed position in which the panel covers the front wall and an open position in which the panel uncovers the front wall;

the panel having an internal surface which is visible when the panel is in the open position;

a pocket on the internal surface of the panel, wherein the pocket comprises a pocket inner surface and a pocket outer surface, further wherein the pocket is configured to removably hold a plurality of currency bills in a readily accessible position on the pocket inner surface;

two spaced indentations traversing the pocket inner surface and pocket outer surface of the pocket, wherein the two indentations are configured to removably hold a gift card in a steady position on the gift product;

the front wall having printed indicia thereon that can be viewed when the panel is in the open position to a person holding the gift product; and the panel having an outside surface which is visible when the panel is in the closed position, with the outside surface having printed indicia thereon that can be viewed when the panel is in the closed position to a person holding the gift product.

2. The gift product of claim 1, further comprising a tab extending outwardly from the free edge of the panel, and a slot on the free edge of the front wall, wherein the slot is configured to removably receive the tab when the panel is in the closed position covering the front wall.

3. The gift product of claim 1, wherein the substantially rectangular-cuboid shaped container, the panel forming the greeting card, the tuck flap, flexible hinge and the pocket comprise a single blank of box stock.

4. The gift product of claim 1, wherein the substantially rectangular-cuboid shaped container, the panel forming the greeting card, the tuck flap, flexible hinge and the pocket comprise a single blank of cardboard.

5. The gift product of claim 1, wherein the substantially rectangular-cuboid shaped container, the panel forming the greeting card, the tuck flap, flexible hinge and the pocket comprise a single thin sheet of plastic.

6. The gift product of claim 1, wherein the printed indicia on the front wall and the outside surface of the panel are substantially identical.

7. The gift product of claim 1, wherein the printed indicia may be selected from the group consisting of personal, corporate, or advertising messages, and logos.

8. A gift product composed of a single sheet blank having a plurality of score lines for folding the sheet blank into a plurality of panels, the sheet blank comprising:

a message panel having a substantially rectangular configuration;

a first side panel having a substantially rectangular configuration and hingedly connected to the message panel at a first fold line along adjacent longitudinal edges of the message panel and the first side panel;

a back panel having a substantially rectangular configuration, the back panel hingedly connected to the first side panel at a second fold line along adjacent longitudinal edges of the back panel and the first side panel;

a second side panel having a substantially rectangular configuration and hingedly connected to the back panel at a third fold line along adjacent longitudinal edges of the second side panel and the back panel;

a front panel having a substantially rectangular configuration, the front panel hingedly connected to the second side panel at a fourth fold line along adjacent longitudinal edges of the second side panel and the front panel;

a third side panel having a substantially rectangular configuration and hingedly connected to the front panel at a fifth fold line along adjacent longitudinal edges of the third side panel and the front panel;

a first closure panel hingedly connected to the top of the front panel at a first closure fold line along adjacent latitudinal edges of the first closure panel and the front panel;

a first tuck flap hingedly connected to the first closure panel at a second closure fold line along adjacent latitudinal edges of the first closure panel and the first tuck flap;

a second closure panel hingedly connected to the bottom of the front panel at a third closure fold line along adjacent latitudinal edges of the second closure panel and the front panel;

a second tuck flap hingedly connected to the second closure panel at a fourth closure fold line along adjacent latitudinal edges of the second closure panel and the second tuck flap;

wherein a substantially rectangular-cuboid shaped container configured to removably hold a single, individually-wrapped, substantially rectangular-cuboid shaped chocolate bar is formed by folding the sheet blank along the third through fifth fold lines such that the front and back panels and the second and third side panels form opposing, spaced apart walls of the container, the container being further formed by folding the sheet blank along the first through fourth closure fold lines so that the first and second closure panels close the opposite ends of a candy compartment with the first tuck flap and the second tuck flap;

wherein the blank is further foldable along the first and second fold lines such that the first side panel and the third side panel are in a generally face-to-face juxtaposition and the message panel is freely foldable to and from a generally face-to-face juxtaposition with a front surface of the front panel to form a greeting card on the container, wherein the front surface of the front panel comprises printed indicia thereon, further wherein an external surface of the message panel comprises printed indicia thereon;

a pocket on an internal surface of the message panel, wherein the pocket comprises a pocket inner surface and a pocket outer surface, further wherein the pocket is configured to removably hold a plurality of currency bills in a readily accessible position; and two spaced indentations traversing the pocket inner surface and pocket outer surface of the pocket, wherein the two indentations are configured to removably hold a gift card in a steady position on the gift product.

9. The gift product of claim 8, further comprising a tab extending outwardly from the free edge of the message panel, and a slot on the free edge of the front panel, wherein the slot is configured to removably receive the tab when the message panel is folded into the generally face-to-face juxtaposition with the front surface of the front panel to form the greeting card on the container.

10. The gift product of claim 8, wherein the single sheet blank is composed of box stock.

11. The gift product of claim 8, wherein the single sheet blank is composed of lightweight fiberboard.

12. The gift product of claim 8, wherein the single sheet blank is composed of thin sheets of plastic.

13. A combined greeting card, money holder, gift card holder and a chocolate bar container comprising:

a) a substantially rectangular-cuboid shaped container configured to removably hold a single, individually-wrapped, substantially rectangular-cuboid shaped chocolate bar having a front panel defining a front face, a rear panel defining a rear face, a top panel, a bottom panel, a left panel, and a right panel each disposed between and connecting said front panel and said rear panel;

b) a container-covering panel hingedly attached to the left panel, the container-covering panel having an internal surface which is visible when the container-covering panel is in the open position and an external surface which is visible when the container-covering panel is in the closed position, with the external surface comprising printed indicia thereon that can be viewed when the container-covering panel is in the closed position to a person holding the combined greeting card, money holder, gift card holder and chocolate bar container;

c) a pocket on the internal surface of the container-covering panel, wherein the pocket comprises a pocket inner surface and a pocket outer surface, further wherein the pocket is configured to removably hold a plurality of currency bills in a readily accessible position;

d) two spaced indentations traversing the pocket inner surface and pocket outer surface of the pocket, wherein the two indentations are configured to removably hold a gift card in a steady position on the combined greeting card, money holder, gift card holder and chocolate bar container; and e) the front face comprising printed indicia thereon that can be viewed when the container-covering panel is in the open position to a person holding the combined greeting card, money holder, gift card holder and chocolate bar container.

14. The combined greeting card, money holder, gift card holder and a chocolate bar container of claim 13, further comprising a tab extending outwardly from the free edge of the panel, and a slot on the free edge of the front wall, wherein the slot is configured to removably receive the tab when the panel is in the closed position covering the front wall.

15. The combined greeting card, money holder, gift card holder and the chocolate bar container of claim 13, wherein the substantially rectangular-cuboid shaped container, the container-covering panel forming the greeting card, flexible hinge and the pocket comprise a single blank of box stock.

16. The combined greeting card, money holder, gift card holder and the chocolate bar container of claim 13, wherein the substantially rectangular-cuboid shaped container, the container-covering panel forming the greeting card, flexible hinge and the pocket comprise a single thin sheet of plastic.

* * * * *